US006068243A

United States Patent [19]

Hoggan

[11] Patent Number: 6,068,243

[45] Date of Patent: May 30, 2000

[54] SELF-LOCKING, ADJUSTABLE-WIDTH SLAT FOR CHAIN LINK FENCES

[75] Inventor: Jefrey A. Hoggan, River Heights, Utah

[73] Assignee: A & B Plastics, Inc., Union Gap, Wash.

[21] Appl. No.: 09/003,077

[22] Filed: Jan. 5, 1998

[51] Int. Cl.[7] ..... B21F 27/00

[52] U.S. Cl. ..... 256/34; 256/32

[58] Field of Search ..... 256/32, 34

[56] References Cited

U.S. PATENT DOCUMENTS

| | | | |
|---|---|---|---|
| Re. 35,208 | 4/1996 | Finkelstein | 256/34 |
| 338,818 | 3/1886 | Baird | 256/34 |
| 2,892,647 | 6/1959 | O'Neill | 287/58 |
| 2,954,964 | 10/1960 | O'Haffey | 256/34 |
| 3,227,423 | 1/1966 | De Matteo | 256/12.5 |
| 3,712,590 | 1/1973 | Tochner et al. | 256/34 |
| 3,958,794 | 5/1976 | Suprunuk et al. | 256/34 |
| 4,085,954 | 4/1978 | Thompson | 256/34 |
| 4,343,567 | 8/1982 | Sarver et al. | 404/10 |
| 4,570,906 | 2/1986 | Walden | 256/34 |
| 4,723,761 | 2/1988 | Cluff | 256/34 |
| 4,860,998 | 8/1989 | Snyder | 256/34 |
| 4,950,098 | 8/1990 | Abbott et al. | 256/34 |
| 4,995,591 | 2/1991 | Humphrey et al. | 256/34 |
| 5,007,619 | 4/1991 | Sibeni | 256/34 |
| 5,184,801 | 2/1993 | Finkelstein | 256/34 |
| 5,234,199 | 8/1993 | Cluff | 256/34 |
| 5,275,380 | 1/1994 | Barsby | 256/34 |
| 5,465,941 | 11/1995 | Abbott | 256/34 |
| 5,584,468 | 12/1996 | Meglino et al. | 256/34 |

FOREIGN PATENT DOCUMENTS

| | | | |
|---|---|---|---|
| 2476736 | 8/1981 | France | 256/34 |

OTHER PUBLICATIONS

Sample of gray M–shaped slat in public use prior to Jan. 5, 1998.

*Primary Examiner*—Terry Lee Melius
*Assistant Examiner*—John R. Cottingham
*Attorney, Agent, or Firm*—Jacobson, Price, Holman & Stern, PLLC

[57] ABSTRACT

A slat for use in chain link fences is provided. The slat generally comprises an elongate, imperforate body member and first and second fins extending from the body member to provide privacy and to lock the slat within a channel of a chain link fence. The first and second fins include portions which are configured and oriented to extend laterally relative to the body member toward fins of adjacently positioned slats to provide privacy. Further, the first and second fins are configured and oriented to extend into knuckles of a chain link fence, to wedge into the knuckles to secure the slats within the channels of the chain link fence. The body member is configured to provide a spring or resiliency to provide the adjustable-width and self-locking capabilities of the slat.

5 Claims, 10 Drawing Sheets

SELF-LOCKING, ADJUSTABLE-WIDTH SLAT FOR CHAIN LINK FENCES

FIELD OF THE INVENTION

The present invention generally relates to chain link fences, and in particular, to slats for use in chain link fences.

BACKGROUND OF THE INVENTION

Generally, fences are utilized in industrial and residential settings to provide both security and privacy. The security objective has generally been met with chain link fences by installing chain link fences at a height that discourages third parties from climbing over the fence and by constructing the fence from a sturdy wire mesh fencing fabric that inhibits penetrating through the fence.

However, the privacy objective is not readily satisfied with chain link fences as such fences are constructed with wire mesh fencing fabric. The fabric or wire is woven diagonally creating a loose or open diamond pattern defined by intermittently spaced links or knuckles in the chain link fence. The knuckles and the fencing fabric also combine to define lateral and vertical channels. The combination of the open, diamond pattern and the channels allows for a nearly undisturbed line of sight through the chain link fence. Therefore, a need exists for improving the chain link fence to provide privacy while still providing security.

SUMMARY OF THE INVENTION

Accordingly, it is an object of the present invention to provide slats for use in a chain link fence to provide privacy.

It is another object of the present invention to provide a slat which is easily installable within channels of chain link fence.

It is yet another object of the present invention to provide a slat for use in chain link fences that is self-locking.

It is another object of the present invention to provide a slat with an adjustable width that provides privacy and is self-locking in chain link fences.

Yet another object of the present invention is to provide a slatted chain link fence having self-locking slats installed therein.

The above objects of the present invention may be fulfilled by providing a slat having at least first and second fins which extend laterally outwardly from an elongate body member. The body member of the slat may include a spring or a resilient means for purposes of providing the self-locking and adjustable-width characteristics of the slat. The first and second fins may be configured and oriented to facilitate installation/insertion of such slats into channels of a chain link fence and to provide privacy while being capable of locking the slat within a channel formed in a chain link fence.

In one embodiment, privacy and ease of installation are achieved by providing first and second fins which extend at least laterally from the body member, such that end portions of the first and second fins extend toward knuckles of the chain link fence and toward the correspondingly configured and oriented first and second fins of adjacently positioned slats of the present invention. To further enhance the privacy and self-locking features of the slat, when the slat is installed and in a released state, the first and second fins and the body member define a released width of the slat which is at least equal to the width of the channels of the chain link fence, as defined by laterally opposing knuckles of the chain link fence. In another embodiment, the slat has first and second released widths along the length of the slat to reduce material costs and to increase installation efficiency. In this regard, the first released width of the slat may be chosen to allow the fins to frictionally engage opposing knuckles, and the second released width of the slat may be chosen to allow the fins to extend laterally outwardly toward opposing knuckles to provide privacy but do not necessarily frictionally engage the knuckles of the chain link fence.

For purposes of enhancing the self-locking and adjustable-width characteristics of the slats of the present invention, the body member includes at least one curved section (e.g. a fold) to provide spring-like functionality. This spring-like functionality of the body member is desired to lock each slat within a channel by providing a laterally outwardly directed force that drives the first and second fins into laterally opposing knuckles. The spring-like functionality is achieved by selecting a released width of the slat that is greater than the width of the channel of the chain link fence and by including at least one curved section. Thus, when the slat is to be installed in a smaller width channel, a compressive force may be laterally applied to the slat to cause the body member to deform or compress laterally, especially at the curved section or fold. The compressive force is applied to reduce the width of the slat such that the compressed slat has a compressed width less than or equal to the width of the channel. Upon installation of the compressed slat within a channel, the compressive force may be released to allow the spring-like body member to extend the first and second fins laterally outwardly, at least toward, and in some instances into, opposing knuckles of the chain link fence to positionally lock the released-state slat within the channel. This laterally outwardly movement of the first and second fins also enhances the privacy provided by the slat as the released body member results in a released width of the slat being at least substantially equivalent to that of the channel width of the chain link fence. In one embodiment, the spring means comprises at least one curved section or fold having a radius of between about 0.031 (1/32) inch to about 0.375 (3/8) inch. In one embodiment, the radius of the fold is about 0.078 (5/64) inch.

In another embodiment, for purposes of enhancing the self-locking and adjustable-width characteristics of the slats of the present invention, the body member includes a resilient means. In one embodiment, the resilient means includes at least one curved section (e.g., a fold) to provide a resilient functionality. The resilient means locks each slat within a channel by deforming (e.g., compressing) the body member to force the first and second fins to move laterally outwardly to enter into and frictionally engage laterally opposing knuckles. This laterally outwardly movement of the first and second fins also enhances the privacy provided by the slat as the deformed body member results in a deformed or inserted width of the slat being substantially equivalent to the channel width of the chain link fence. The resilient means in this embodiment is achieved by selecting the released width of the slat to be less than or equal to the width of the channel of the chain link fence and by selecting the released depth of the body member to be greater than the depth of the channel. Thus, when installing the slat in a channel having a depth less than the depth of the slat, a compressive force may be applied to deform the slat, specifically about the curved section or fold of the body member, whereby proximal and distal portions of the chain link fence may abuttingly engage the body member to force the first and second fins laterally outwardly. The compressive force may be applied to reduce the depth of the slat such that the depth of the compressed slat is less than or equal to the depth of the channel.

In another aspect, the slats of the present invention may be used in combination with a runner to enhance vertical support and positional locking of the slats within the channels of chain link fences. The runner may include one intermediate runner wall extending between a distal wall and a proximal wall to provide vertical support for a slat that is inserted into a channel of a chain link fence. In one embodiment, the runner includes first and second enclosure walls that extend laterally inwardly from and relative to the distal and proximal walls of the runner. The first and second enclosure walls may extend laterally inwardly from the distal and proximal walls at an angle of less than ninety degrees relative to the distal and proximal walls, respectively, to abuttingly contact and guide a slat toward the intermediate runner wall of the runner. In this regard, slats guided into the runner may abuttingly contact the distal, proximal, and enclosure walls of the runner to enhance the vertical support of the slats and to enhance the locking of the slats within the channels of the chain link fence. To provide such vertical support, the runner of the present invention may be inserted into a laterally extending channel of a chain link fence defined by proximal and distal portions of the wire mesh fencing fabric and longitudinally opposing knuckles of the chain link fence. In this regard, the runner may be sized and configured to be receivable within a laterally extending channel and to receive an end portion of a slat inserted longitudinally into a channel of the chain link fence.

In another aspect, the present invention is directed to a method for making a slatted chain link fence by installing adjustable-width, self-locking slats within the channels of the chain link fence. Utilizing the adjustable-width, self-locking slats of the present invention obviates steps of properly selecting and sizing a slat for various channel sizes and mechanically locking each slat within the channel after installation. In this regard, the method of the present invention provides an efficient method of making slatted chain link fences that achieve the object of privacy.

DETAILED DESCRIPTION OF THE INVENTION

Figure 1:
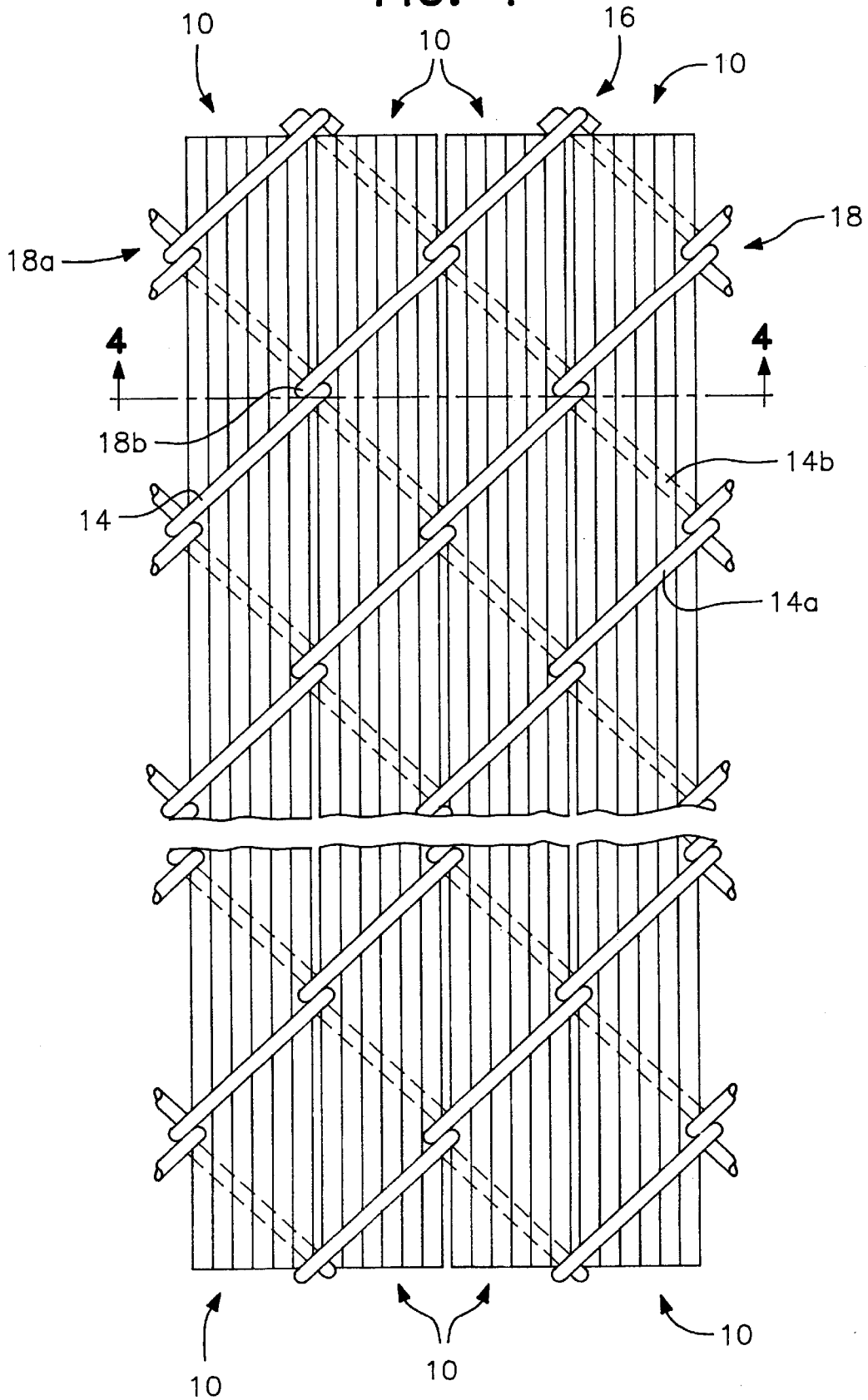
FIG. 1 is an elevational view of a chain link fence illustrating one embodiment of the slats of the present invention inserted therein with an intermediate portion being broken out for convenience of illustration.
Figure 2:
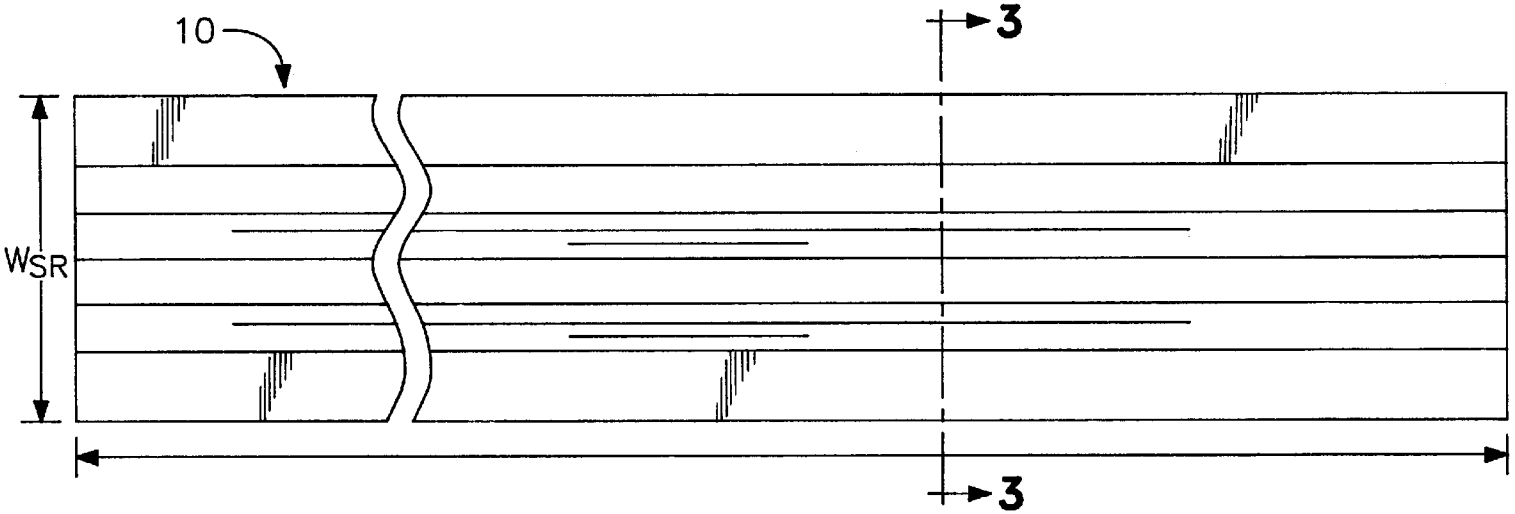
FIG. 2 is an elevational view of a face of one of the slats of the present invention illustrated in FIG. 1.

The present invention is directed to a slat that may be used with a wide range of chain link fences to provide privacy in both residential and industrial settings. Chain link fences are generally constructed from a sturdy wire mesh fencing fabric. The fabric or wire is woven diagonally creating a loose or open diamond pattern that is defined by intermittently spaced links or knuckles in the fence. The knuckles and the fencing fabric define laterally extending channels and longitudinally extending channels. For ease of description, in the discussion of the slat of the present invention, the term "distal" refers to the direction towards the back side of a chain link fence. Similarly, the term "proximal" refers to the direction toward the front side of a chain link fence.

To provide privacy, the slats of the present invention may be inserted within the longitudinally extending channels of the chain link fence. Each slat of the present invention generally comprises an elongate, expandable body member and first and second fins that extend laterally outwardly from the body member. The body member includes a spring means, whereby the width of the slat increases when released from a compressed state and decreases when compressed from a released state. In this regard, when the slat is released from a compressed configuration, the spring means causes the slat to laterally outwardly expand to force the fins into opposing knuckles to thereby lock the slat in the channel and provide privacy when the slats are installed in chain link fences. In view of this variable width feature, the slats of the present invention may be used in various chain link fences of varying channel sizes.

FIGS. 1–14 illustrate various embodiments of the self-locking, adjustable-width slat of the present invention. In one embodiment, shown in FIGS. 1–5, each slat 10 of the present invention is receivable within a channel 12 defined by the wire mesh fencing fabric 14 of the chain link fence 16. Each longitudinally extending channel 12 is generally defined by proximal and distal portions 14*a*, 14*b* of the wire mesh fencing fabric 14 and by opposing, intermittingly spaced weaves or knuckles 18*a*, 18*b* at intersections of the wire mesh fencing fabric 14. The distance between any two laterally opposing knuckles 18*a*, 18*b* defines the width, $w_c$, of each channel 12, as shown in FIG. 4. In this regard, each of the slats 10 may be sized and configured to be receivable and lockable within each of the channels 12 of the chain link fence 16 to thereby provide privacy (as will be described in more detail hereinbelow).

Figure 3:
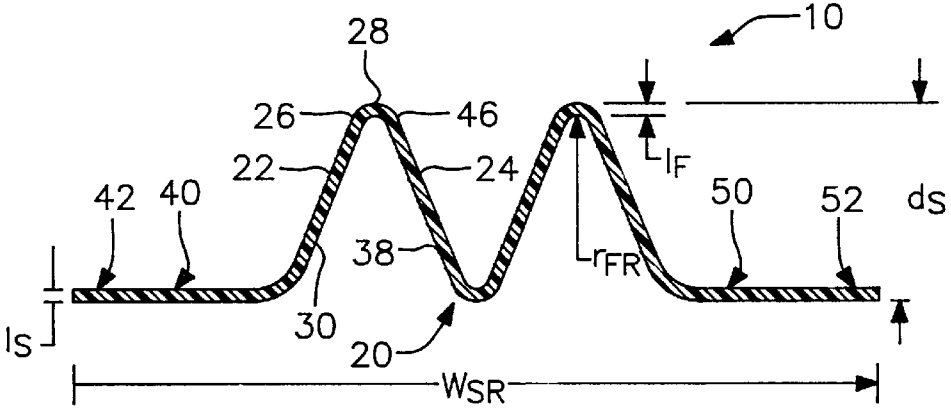
FIG. 3 is a cross-sectional view of the present invention taken along line 3—3 of FIG. 2 and drawn to a larger scale.
Figure 4:
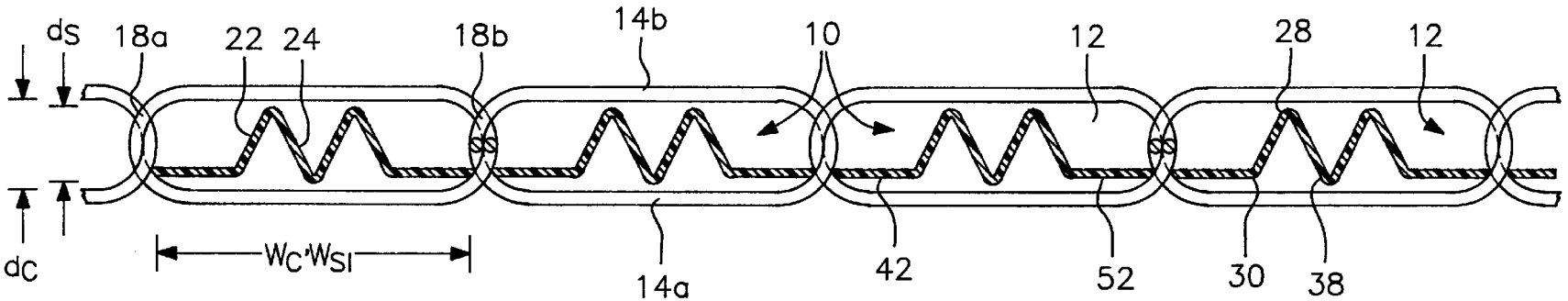
FIG. 4 is a cross-sectional view taken along line 4—4 of FIG. 1 and drawn to a larger scale.
Figure 5:
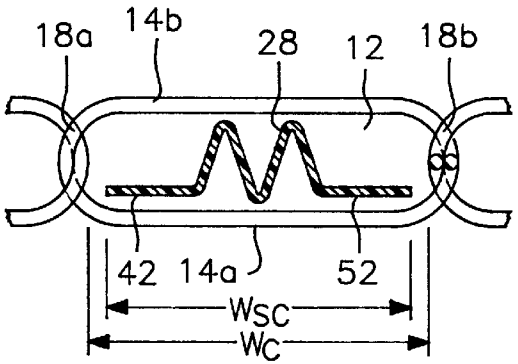
FIG. 5 is a cross-sectional view of one embodiment of the slat of the present invention laterally compressed and inserted into a chain link fence.
Figure 6A:
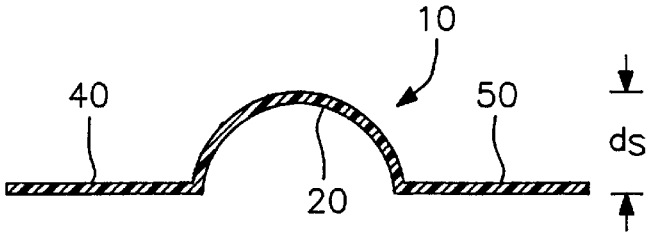
FIGS. 6*a*–6*e* are cross-sectional views of alternative embodiments of the slats of the present invention.
Figure 6B:
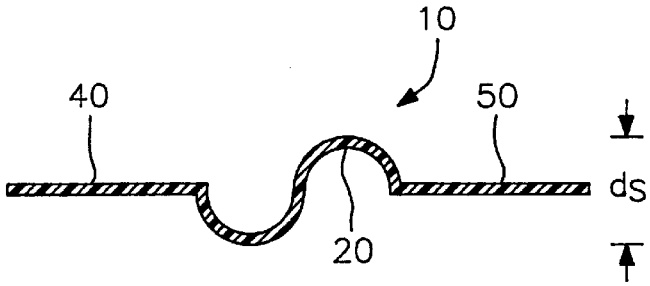
Figure 6C:
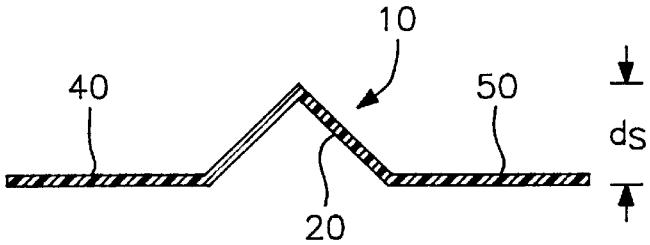
Figure 6D:
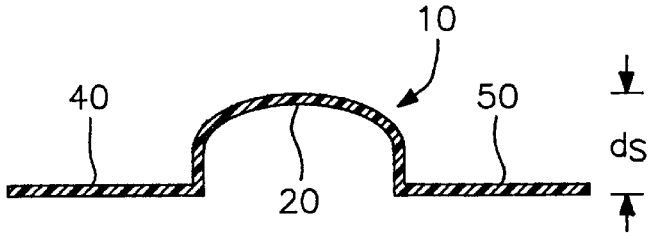
Figure 6E:
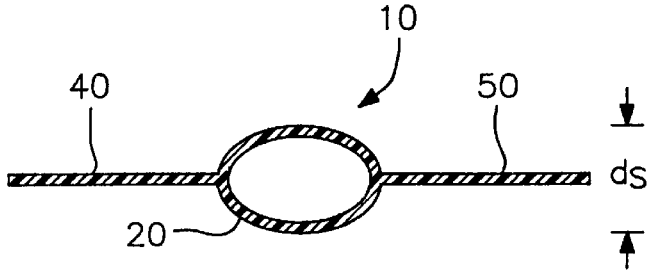

In one embodiment, illustrated in FIGS. 1–5, each slat 10 includes an elongate, expandable body member 20 and first and second fins 40, 50 extending laterally outwardly from the body member 20. As noted hereinabove, the slat 10 includes an elongate, expandable body member 20 that is configured to provide a spring force to facilitate installation and to lock the slat 10 in the channel 12. More specifically, the body member 20 generally functions as a spring, whereby the body member 20 has a propensity to extend the fins 40, 50 outwardly laterally when released from a distorted (e.g., compressed) configuration, as shown in FIG. 5. In one embodiment of the present invention, illustrated in FIG. 3, the body member 20 has an accordion or "W" cross-sectional configuration to provide this spring force. In this embodiment, the body member 20 includes at least a first wall 22 and an adjacent second wall 24. The first and second walls 22, 24 extend along at least a portion of a longitudinal axis of the slat 10. A longitudinally extending fold 28 extends between the distal end portions 26, 46 of the first and second walls 22, 24 to provide the body member 20 with the spring characteristics for forcing end portions 42, 52 of the first and second fins 40, 50 into laterally opposing knuckles 18*a*, 18*b*. To provide the selected spring force for locking the slat 10 within the channel 12 and to give the slat 10 flexibility for facilitating installation, the fold 28 of this embodiment has a radius, $r_{FR}$, of less than about 0.5 inch, and in a preferred embodiment, between about 0.031 (1/32) inch to about 0.375 (3/8) inch with the slat 10 in a released state (e.g. not under compressive forces, as will be described in more detail hereinbelow). In a preferred embodiment, where the body member 20 has a "W" cross-sectional configuration, the radius, $r_F$, of the fold 28 in the released state is about 0.078 (5/64) inch.

As a result of such spring-like functionality provided by the body member 20, privacy and self-locking capabilities are achieved by the slat 10 as the body member 20 functions to drive end portions 42, 52 of the first and second fins 40, 50 into at least a first pair of laterally opposing knuckles 18*a*, 18*b* such that the first and second fins 40, 50 frictionally engage the laterally opposing knuckles 18*a*, 18*b* to positionally lock the slat 10 within the channel 12. A high degree of privacy is also provided because the first and second fins 40, 50 extend toward corresponding portions of adjacently positioned fins of adjacently inserted slats 10, as illustrated in FIGS. 1 and 4, thereby minimizing the distance between adjacently inserted slats 10 in chain link fence 16. In this regard, the first and second fins 40, 50 of the slat 10 can be configured so that when a slat 10 is inserted within a channel 12, the end portions 42, 52 enter into and frictionally engage at least a first knuckle 18*a* and at least a second laterally opposing knuckle 18*b*, thereby locking the slat 10 within a channel 12.

Various configurations of the body member 20 may be adapted to provide a spring force. Generally, the cross-sectional configuration may be selected such that when a compressive force is laterally applied to the slat 10, the body member 20 absorbs the compressive force. When the compressive force is removed, the body member 20 releases at least a portion of the absorbed force in the form of an expansive spring force to move the fins 40, 50 laterally outwardly into laterally opposing knuckles 18*a*, 18*b* to thereby lock the slat 10 into a channel 12. FIGS. 6*a*–6*e* illustrate alternative embodiments of body member 20 that may be selected in addition to the embodiment shown in FIG. 3. These other embodiments include cross sectional configurations consisting of at least one V-shape, U-shape, S-shape, arch-shape, and substantially elliptical-shape.

Referring to FIG. 3, for purposes of providing adequate spring force and strength to provide privacy and to lock the slats 10 within channels 12, a thickness, $t_S$, of the fins 40, 50 and a thickness, $t_F$, of the fold 28 may be selected. Generally, as the thickness, $t_F$, of the fold 28 increases, the spring force and locking capability of the slat 10 also increase. However, increasing the thickness, $t_F$, of the fold 28 also increases the material cost of the slat 10 and may make insertion of the slat 10 within the channel 12 more difficult if the slat 10 becomes less flexible. For the purposes of minimizing manufacturing costs and facilitating installation, in one embodiment of the present invention, the thickness, $t_S$, of the fins 40, 50 is equal to the thickness, $t_F$, of the fold 28. In one embodiment, the thicknesses, $t_S$ and $t_F$, of the fins 40, 50 and the fold 28 are at least about 0.018 inches to provide adequate spring force and strength to lock the slat 10 within a channel 12 while minimizing material and installation labor costs. However, the thicknesses, $t_S$ and $t_F$, of the fins 40, 50 and the fold 28 may be varied in different portions of the body member to reduce material cost while still providing adequate spring force and strength.

As shown in FIG. 3, the slat 10 of the present invention has a released width, $w_{SR}$, defined by the body member 20 and the first and second fins 40, 50. The released width, $w_{SR}$, is selected to be greater than the width, $w_C$, of the channel 12 to provide sufficient spring force to lock the slat 10 in the channel 12. In one embodiment, the inserted, released width, $w_{SI}$, of the slat 10 is substantially equal to the width, $w_C$, of the channel 12 as shown in FIG. 4. The first and second fins 40, 50 extend laterally outwardly from the body member 20 of the slat 10 so that end portions 42, 52 enter into and frictionally engage at least the first knuckle 18*a* and the laterally opposing second knuckle 18*b*, respectively, of the chain link fence 16, thereby positionally locking the slat 10 within the channel 12. The width, $w_{SR}$, of the slat 10 may be uniform along the entire length of the slat 10 to provide a very high degree of privacy and positional locking.

In use, a compressive force is laterally applicable to at least the end portions 42, 52 of the slat 10 to compress the body member 20 to thereby reduce the width of the slat 10 to a compressed width, $w_{SC}$. FIG. 5 illustrates the cross-sectional configuration of one embodiment of the slat 10 when a compressive force has been applied to the body member 20. As shown in FIG. 5, the width, $w_{SC}$, of the slat 10 in a compressed state is less than the width, $w_C$, of the channel 12 to facilitate installation of the slat 10 within the channel 12. The proximal portions 30, 38 of the first and adjacent second walls 22, 24 and the folds 28 are urged laterally toward each other while the folds 28 bend, thus reducing the radii, $r_{FC}$, of the folds 28, which generates a spring force. The slats 10 may then be inserted into the channels 12. Upon release of the compressive force on the slat 10, the body member 20 releases a laterally expansive spring force within the channel 12. As shown in FIG. 4, when the slat 10 is inserted within the channel 12 and the compressive force is removed, the folds 28 attempt to return or spring to their original state (e.g., noncompressed), which thereby causes the proximal ends 30, 38 of the first and adjacent second walls 22, 24 to move farther apart laterally. The inserted, released width, $w_{SI}$, of the slat 10 becomes equal to the width, $w_C$, of the channel 12 as the body member 20 expands toward its released state. As the first and adjacent second walls 22, 24 and folds 28 move laterally apart, the end portions 42, 52 of the first and second fins 40, 50 are forced into at least the first pair of laterally opposing knuckles 18*a*, 18*b* to lock the slat 10 securely within the channel 12. In this regard, the spring force of the body member 20 expands the width of the slat, $w_{SI}$, to be substantially equal to the channel width, $w_c$. As illustrated in FIGS. 1 and 4, this expansion of the body member 20 provides privacy by minimizing gaps between adjacently inserted slats 10 in chain link fence 16 while securely locking the slat 10 within the channel 12.

Figure 7:
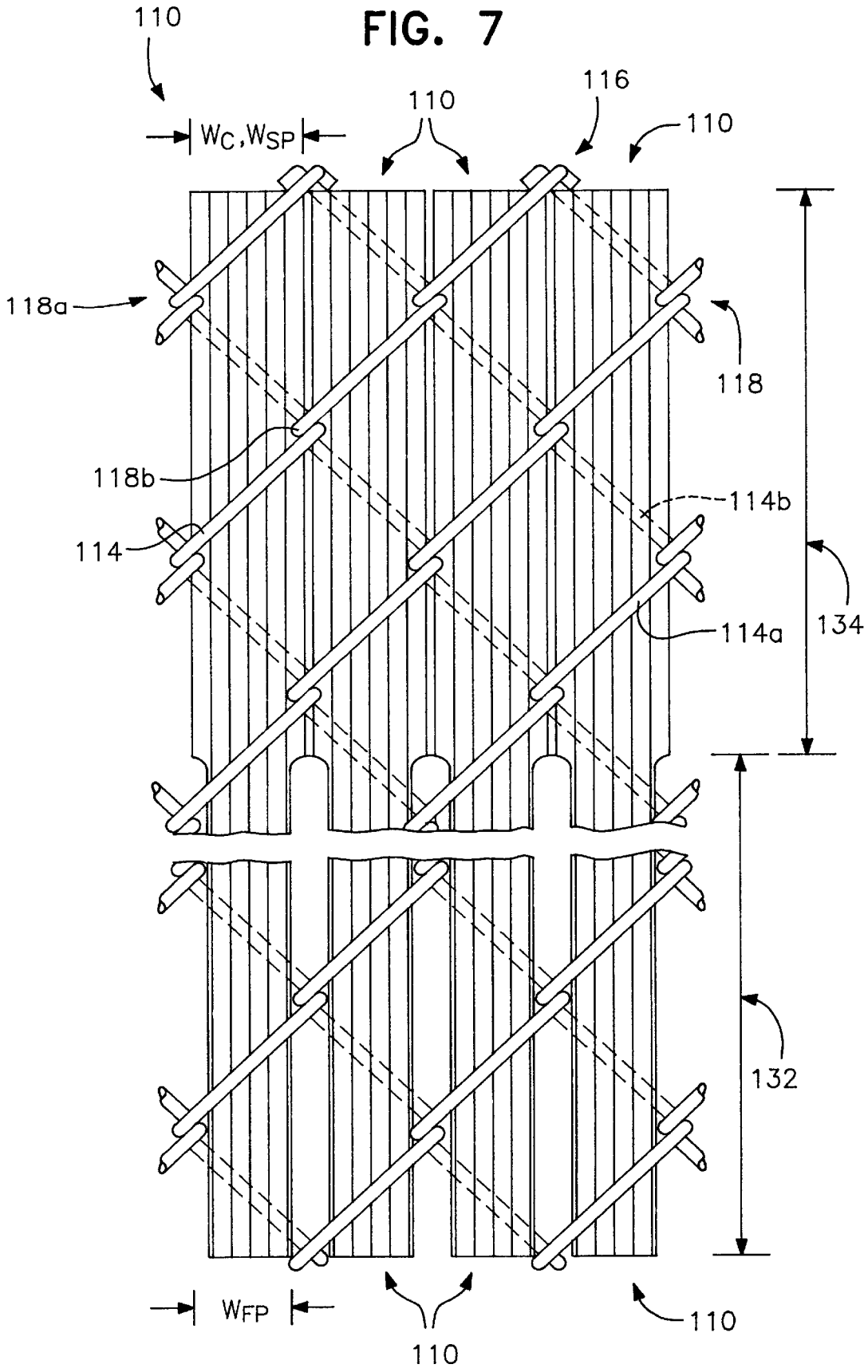
FIG. 7 is an elevational view of a chain link fence illustrating an alternative embodiment of the slats of the present invention inserted therein with an intermediate portion being broken out for convenience of illustration.
Figure 8:
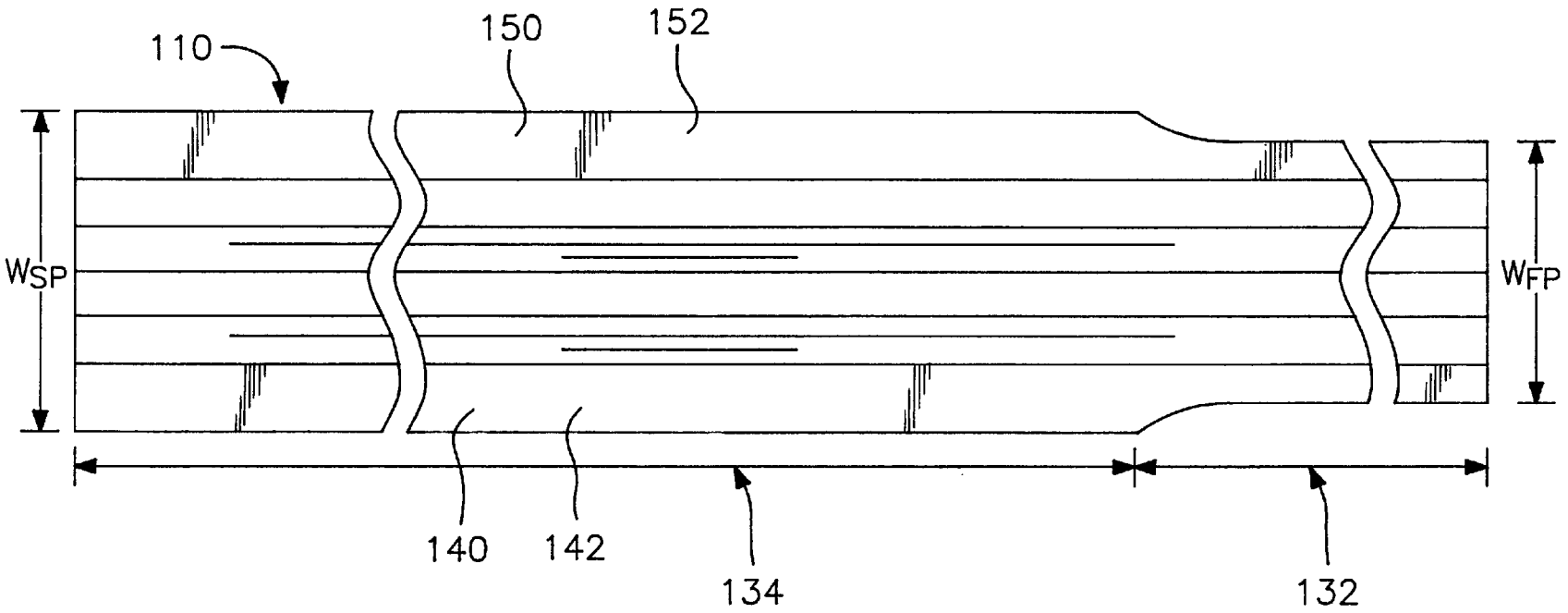
FIG. 8 is an elevational view of a face of one of the slats of the present invention illustrated in FIG. 7.

In another embodiment, illustrated in FIGS. 7 and 8, the slat 110 may have different widths along the length of the slat 110 to reduce material costs and increase installation efficiency. In this embodiment, the slat 110 includes a first portion 132 having a first released width, $W_{FP}$, and a second portion 134 having a second released width, $w_{SP}$, different than the first released width, $W_{FP}$. When a slat 110 is inserted and released within the chain link fence 116 (e.g., in a released state within a channel), as shown in FIGS. 7 and 8, the width, $w_{SP}$, of the slat 110 in the second portion 134 of the slat 110 is substantially equal to the width, $w_C$, defined by the distance between any two laterally opposing knuckles 118*a*, 118*b*. In the second portion 134 of the slat 110, the first and second fins 140, 150 are sized to extend laterally outwardly from the body member 120 such that at least end portions 142, 152 of the first and second fins 140, 150 enter into and frictionally engage at least a first pair of laterally opposing knuckles 118 (e.g. the first and second knuckles 118*a*, 118*b* of the chain link fence 116) to positionally lock the slat 110 in the chain link fence 116. In addition, the first portion 132 of the slat 110 has a width, $w_{FP}$, when inserted and released within the chain link fence 116, that is less than the channel width, $w_C$, of the chain link fence 116. In this regard, insertion of the slat 110 into the chain link fence 116 is facilitated since no compressive force need be applied during insertion to avoid abutting contact between the slat 110 and the knuckles 118. To provide enhanced privacy, the first and second fins 140, 150 of the first portion 132 of the slat 110 can be sized to extend towards and/or into the knuckles 118*a*, 118*b* of the chain link fence 116. In this regard, the width, $w_{FP}$, of the first portion 132 of the slat 110 may be chosen to minimize material costs and to facilitate installation while still providing a high degree of privacy. When this embodiment of the slat 110 is installed in a chain link fence 116, the ratio of the width, $w_{FP}$, of the first portion 132 of the slat 110 to the width, $w_{SP}$, of the slat 110 in the second portion 134 may be any ratio less than or equal to 1:1 and preferably the ratio ranges from about 1:5 to about 19:20. In one embodiment, the ratio is 3:4. This embodiment of the present invention is installed in substantially the same manner as slat 10 illustrated in FIGS. 1–5.

Figure 9:
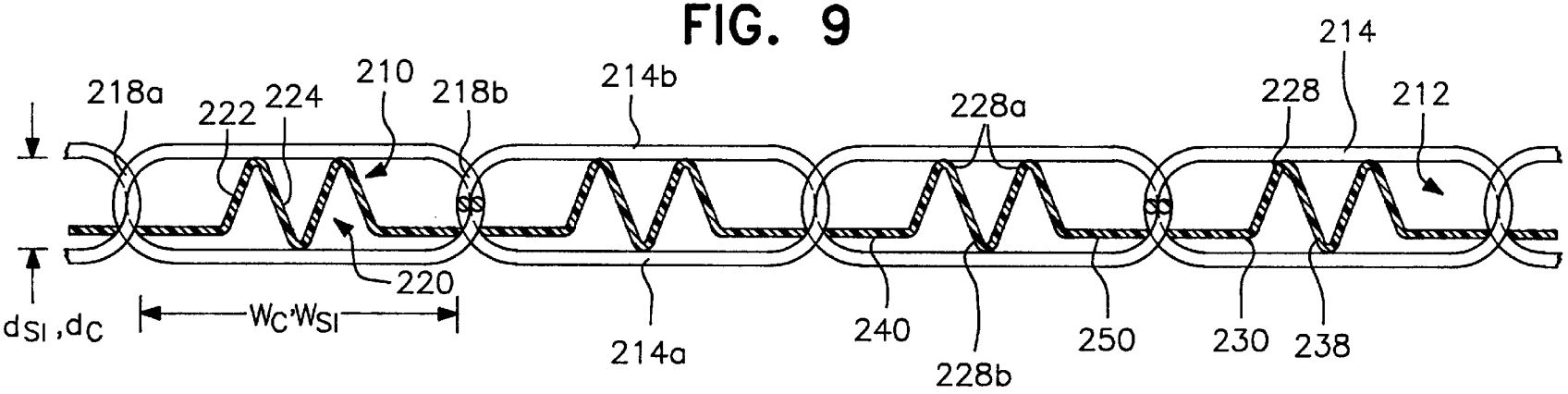
FIG. 9 is a cross-sectional view of a chain link fence with an alternative embodiment of the slats of the present invention inserted therein.
Figure 10:
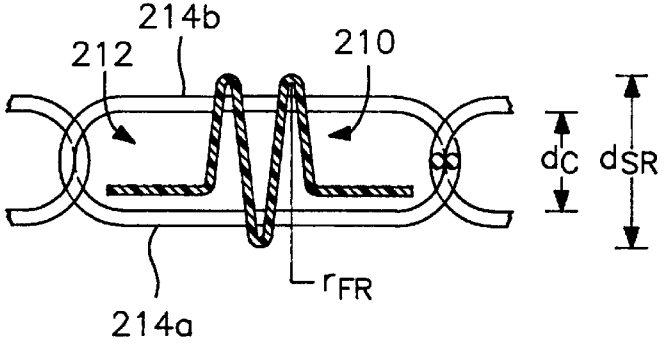
FIG. 10 is a cross-sectional view of one embodiment of the slat of the present invention prior to insertion into a chain link fence.

In another embodiment of the present invention, shown in FIG. 9, the slat 210 includes an elongate, expandable body member 220 that provides a resilient means for locking the slat 210 in the channel 212. In one embodiment, as shown in FIG. 9, the body member 220 has an accordion or "W" cross-sectional configuration. However, other cross-sectional configurations may be selected (e.g., see FIGS. 6*a*–6*e*). In this embodiment, as shown in FIG. 10, the slat 210 has a depth, $d_{SR}$, prior to insertion within the channel 212, that is greater than the depth, $d_C$, of the channel 212, as defined by the distance between the proximal and distal portions 214*a*, 214*b* of the wire mesh fencing fabric 214. Upon insertion of the slat 210 into a channel 212, as shown in FIG. 9, at least distal folds 228*a* and proximal fold 228*b* of the body member 220 abuttingly contact the proximal and distal portions 214*a*, 214*b*, respectively, of the wire mesh fencing fabric 214. This abutting contact forces the folds 228 of the body member 220 to bend by forcing the first and adjacent second walls 222, 224 and folds 228 laterally apart thereby increasing the radius, $r_{FC}$, of the fold 228 and reducing the inserted depth, $d_{SI}$, of the slat 210 to that of the depth, $d_C$, of the channel 212 to facilitate insertion of the slat 210. The laterally outwardly movement of the first and adjacent second walls 222, 224 forces the first and second fins 240,250 to move laterally outwardly from the body member 220 and to engage at least a first pair of laterally opposing knuckles 218*a*, 218*b* to thereby lock the slat 210 in the channel 212. To provide the characteristics of flexibility and resiliency needed to facilitate insertion, the folds 228 of the body member 220 may each have a radius, $r_{FR}$, prior to insertion ranging from about 0.01 inches to about 0.5 inches. In one embodiment, the radius, $r_{FR}$, is about 0.05 inches.

In another aspect of the present invention, illustrated in FIGS. 11–14, the slat 310 is used in combination with an elongate runner 360 to enhance the positional locking of the slat 310 within the channel 312 of the chain link fence 316. Each runner 360 is receivable within a lateral channel 358 defined by proximal and distal portions 314*a*, 314*b* of the wire mesh fencing fabric 314 and by at least a first pair of longitudinally opposing, intermittingly spaced weaves or knuckles 336*a*, 336*b* at intersections of the wire mesh fencing fabric 314. In this regard, each of the runners 360 may be sized and configured to be receivable within each of the lateral channels 358 of the chain link fence 316.

Figure 11:
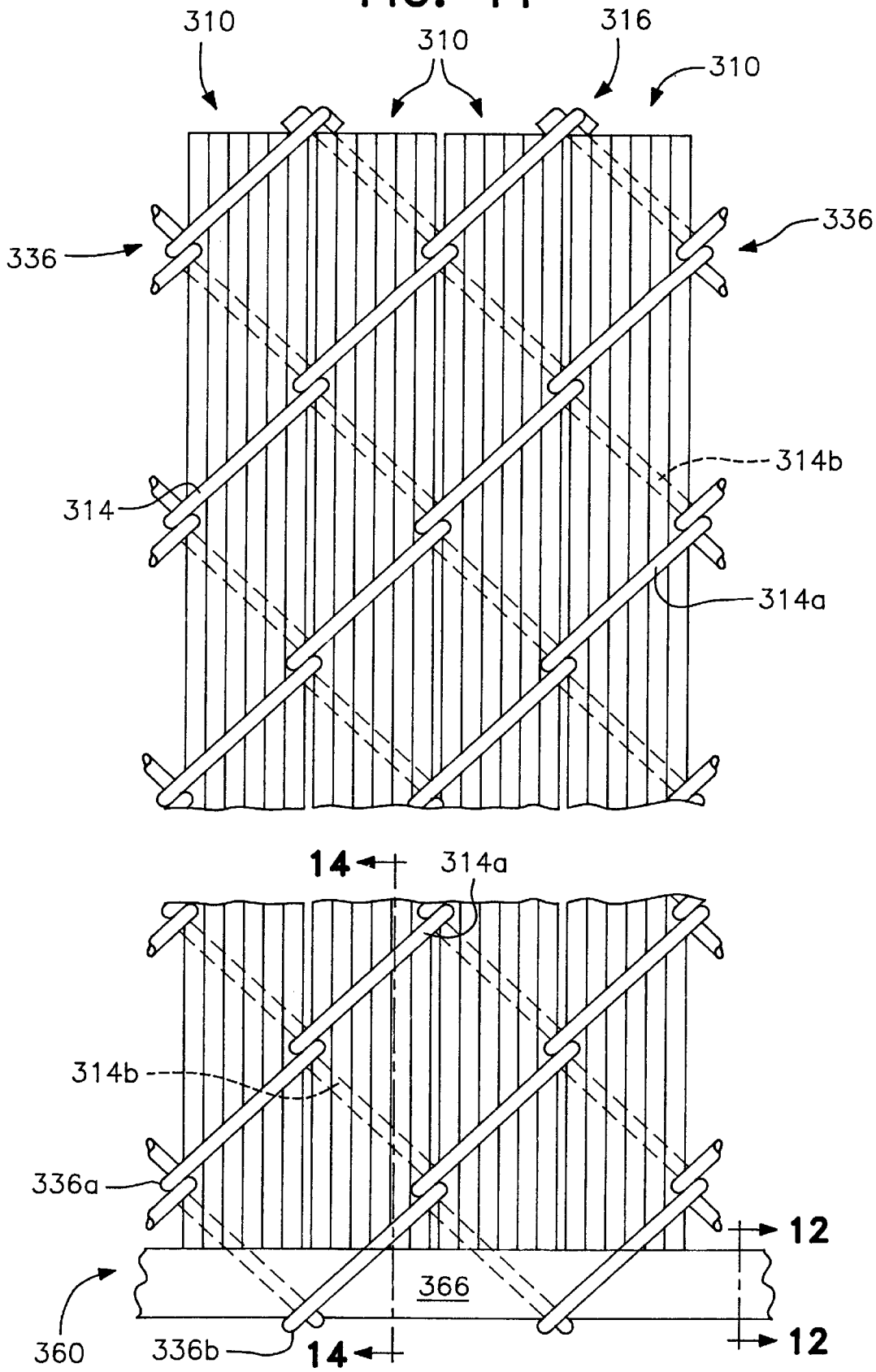
FIG. 11 is an elevational view of a chain link fence illustrating one embodiment of the slats of the present invention inserted therein with a runner, an intermediate portion being broken out for convenience of illustration.
Figure 12:
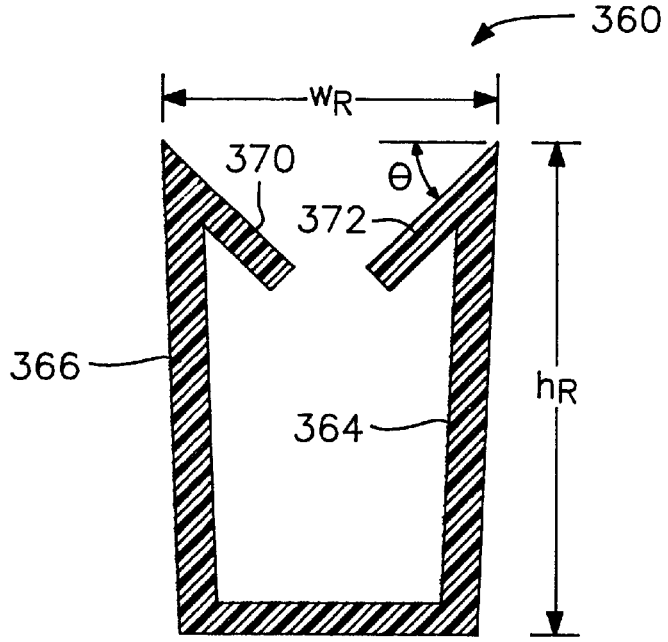
FIG. 12 is a cross-sectional view taken along line 11—11 of FIG. 10 and drawn to a larger scale.
Figure 13:
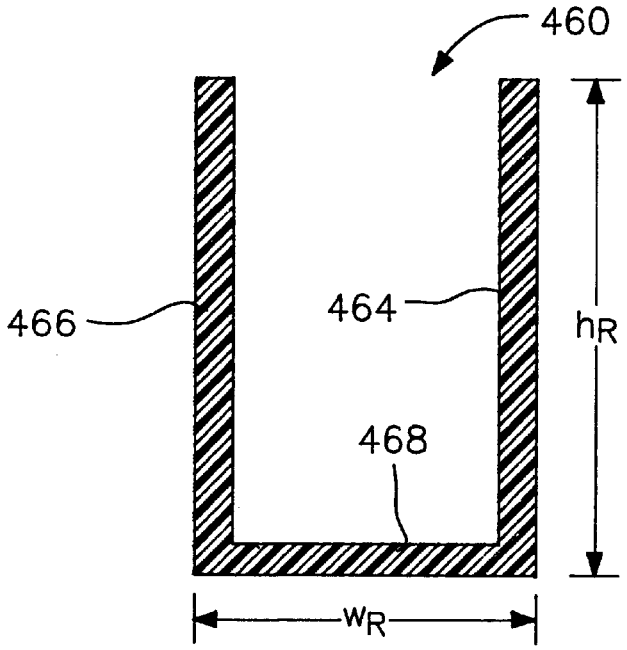
FIG. 13 is a cross-sectional view of an alternative embodiment of the runner of the present invention.

In one embodiment, shown in FIGS. 11 and 12, the elongate runner 360 includes one intermediate runner wall 368 extending between a distal wall 364 and a proximal wall 366. The runner 360 also includes a first enclosure wall 370 and a second enclosure wall 372 extending laterally inwardly at an angle, $\Theta$, relative to the distal and proximal walls 364, 366, respectively, for at least a portion of the elongate runner 360. To facilitate insertion of the slat 310 within the runner 360, the angle, $\Theta$, is preferably less than or equal to 90 degrees. As such, the first and second enclosure walls 370, 372 abuttingly contact and guide a lower end portion of the slat 310 into the runner 360, between the distal and proximal walls 364, 366. However, alternative embodiments of the runner without enclosure walls may be selected (e.g., see FIG. 13) to reduce material costs or to facilitate the insertion of various cross-sectional configurations of the slat of the present invention.

Figure 14:
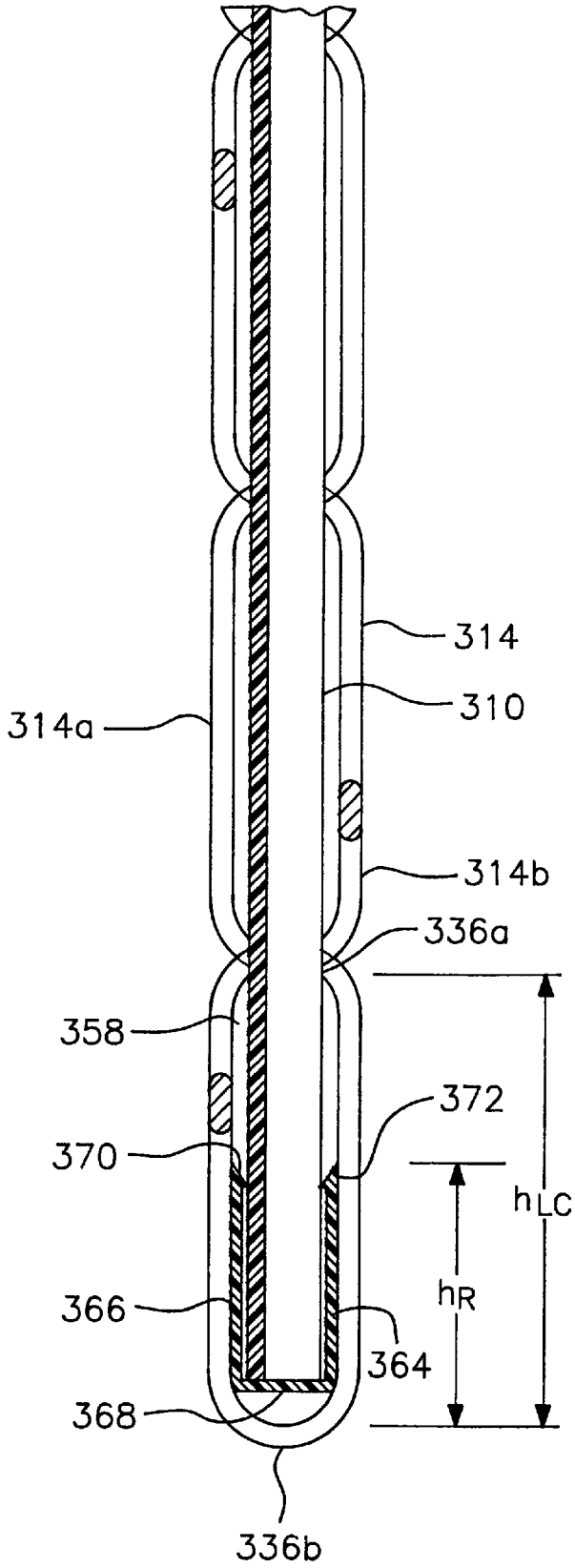
FIG. 14 is a cross-sectional view taken along line 13—13 of FIG. 10 and drawn to a larger scale.

To facilitate insertion of the runner 360 into a laterally extending channel 358, the height, $h_R$, of the runner 360 is less than the height, $h_{LC}$, of the lateral channel 358 as defined by the distance between the first pair of longitudinally opposing first and second knuckles 336*a*, 336*b*. In use, and for purposes of receiving and supporting the slat 310, the runner 360 is insertable within the lateral channel 358, as shown in FIG. 14. Upon insertion of the slat 310 in the chain link fence 316, the first and second enclosure walls 370, 372 are abuttingly engageable with the slat 310 to guide the slat 310 into the runner 360. The distal and proximal walls 364, 366 frictionally contact portions of the wire mesh fabric 314 to secure the runner 360 in the lateral channel 358. To further enhance locking of the slat 310 achieved by the embodiments of the present invention previously described, the first and second enclosure walls 370, 372 are frictionally engageable with at least distal and proximal portions of the slat 310. To support the slat 310 in the chain link fence 316, a longitudinal end portion of an inserted slat 310 may abuttingly engage the intermediate runner wall 368 and the first and second enclosure walls 370, 372.

The slats and runners of the present invention may be fabricated from materials having the characteristics of ductility and tensile strength. In one embodiment, the slat and runner are selected from the group consisting of plastics and metals. Plastic materials provide the spring force characteristics needed for slat of the present invention and are inexpensive to fabricate, durable, and readily made opaque or imperforate for privacy. In one embodiment, for purposes of providing lightweight, flexible slats and runners that may be efficiently installed in channels of a chain link fence, the slats and runners are fabricated from a plastic material, such as a high or medium density polyethylene, a linear low density polyethylene (co-extruded), a polypropylene copolymer, ethyl-vinyl acetate, or a low density polyethylene. As end portions of the first and second fins of the slat are receivable and wedgable within knuckles of chain link fences and are subject to tensile stresses, at least the first and second fins may be fabricated from these plastic materials and should have a tensile strength of at least about 1000 psi. In one embodiment, the slats, and in particular the fins, are fabricated from a plastic material having a tensile strength of at least about 2500 psi and, in yet another embodiment, at least the fins are fabricated from a high density polyethylene having a tensile strength of about 4400 psi.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described here and above are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. A slat for insertion in a channel of a chain link fence, the channel being defined by proximal and distal portions of wire mesh fencing fabric of the chain link fence and on opposite sides by a plurality of intermittently spaced, opposing knuckles defined at intersections of the wire mesh fencing fabric, the distance between the proximal and distal portions of the wire mesh fencing fabric defining the depth of a channel and the distance between the opposing knuckles defining the width of a channel, said slat comprising:

an elongate, imperforate, expandable body member receivable within the channel; and first and second fins extending from said expandable body member for locking said slat within the channel, said first and second fins each having longitudinally extending terminal edge portions, the distance between said terminal edge portions defining the width of said slat, said body member including a longitudinally extending resilient portion for adjusting said width of said slat between a compressed width which is less than the width of a channel and an expanded width which is at least equal to the width of a channel, said resilient portion biasing said slat to said expanded width, wherein, when said slat is laterally squeezed to said compressed width, said terminal edge portions of said first and second fins are free of locking engagement with the knuckles of a channel, and when said resilient portion biases said slat to said expanded width, said terminal edge portions of said first fin extends from said expandable body member to engage at least a first knuckle and said terminal edge portions of said second fin extends from said expandable body member to engage at least a second knuckle opposite the first knuckle, said resilient portion of said body member of said slat being generally W-shaped in transverse cross-section, the body member including at least a pair of longitudinally extending inner walls having inner edge portions resiliently connected to each other to form a resilient central apex, and a pair of longitudinally extending outer walls having inner edge portions resiliently connected to outer edge portions of said inner walls to form a pair of resilient outer apices spaced transversely from each other and opposed to said central apex, each of said outer walls including outer edge portions spaced from its respective outer apex and generally transversely aligned with said central apex, said fins extending transversely from said outer edge portions of said outer walls, whereby said first and second fins are juxtaposed to one of the proximal and distal portions of the wire mesh fencing fabric when said slat is inserted into a channel, to thereby block visual access across the depth of a channel and lockingly engage the slat within the channel.

2. A slat, as claimed in claim 1, wherein a first portion of said slat defined by said expandable body member and said first and second fins corresponds to a first width and a second portion of said slat defined by said expandable body member and said first and second fins corresponds to a second width different than said first width.

3. A slatted chain link fence comprising, in combination:

a chain link fence structure having wire mesh fencing fabric and a plurality of longitudinally extending, first channels defined by proximal and distal portions of the wire mesh fencing fabric and by a first plurality of intermittently spaced, laterally opposing knuckles at intersections of the wire mesh fencing fabric, the distance between the proximal and distal portions of the wire mesh fencing fabric defining the depth of the first channels and the distance between the opposing knuckles defining the width of the first channels; and a plurality of slats according to claim 1 inserted in the first channels with said terminal edge portions of said first fins frictionally engaging a first knuckle of its associated channel and said terminal edge portions of said second fins frictionally engaging a second knuckle opposite the first knuckle of the channel, said resilient portion of said body member of each of said slats being generally W-shaped in transverse cross-section, the body member including at least a pair of longitudinally extending inner walls having inner edge portions resiliently connected to each other to form a resilient central apex, and a pair of longitudinally extending outer walls having inner edge portions resiliently connected to outer edge portions of said inner walls to form a pair of resilient outer apices spaced transversely from each other and opposed to said central apex, each of said outer walls including outer edge portions spaced from its respective outer apex and generally transversely aligned with said central apex, said fins extending transversely from said outer edge portions of said outer walls, whereby said first and second fins are juxaposed to one of the proximal and distal portions of the wire mesh fencing fabric, to thereby block visual access across the depth of the channels and lock the slats within the channels.

4. A slatted chain link fence, as claimed in claim 3, wherein said slats each include first and second longitudinally spaced portions of different widths.

5. A slatted chain link fence, as claimed in claim 3, wherein said chain link fence structure includes a plurality of laterally extending, second channels defined by the proximal and distal portions of the wire mesh fencing fabric and by a second plurality of intermittingly spaced, longitudinally opposing knuckles defined by intersections of the wire mesh fencing fabric, said fence further comprising:

a runner received in one of said plurality of said second channels, said runner comprising spaced distal and proximal walls interconnected at their lower edges, wherein end portions of said slats are received within said runner, between said distal and proximal walls.

* * * * *